US009082546B2

(12) United States Patent
Komura et al.

(10) Patent No.: US 9,082,546 B2
(45) Date of Patent: Jul. 14, 2015

(54) METHOD OF MAGNETIZING INTO PERMANENT MAGNET

(75) Inventors: Haruhiro Komura, Aichi (JP); Mikio Kitaoka, Shizuoka (JP); Ikuo Ohashi, Shizuoka (JP); Teruo Kiyomiya, Shizuoka (JP); Sachiko Shinmura, Shizuoka (JP); Nobuyuki Sueyoshi, Shizuoka (JP)

(73) Assignee: Minebea Co., Ltd., Nagano (JP)

( * ) Notice: Subject to any disclaimer, the term of this patent is extended or adjusted under 35 U.S.C. 154(b) by 1849 days.

(21) Appl. No.: 11/821,508

(22) Filed: Jun. 22, 2007

(65) Prior Publication Data

US 2008/0122565 A1 May 29, 2008

Related U.S. Application Data

(63) Continuation of application No. PCT/JP2005/023513, filed on Dec. 21, 2005.

(30) Foreign Application Priority Data

Dec. 24, 2004 (JP) ..... 2004-374918
Nov. 29, 2005 (JP) ..... 2005-343193

(51) Int. Cl.
*H01F 41/02* (2006.01)
*H01F 1/40* (2006.01)
*H01F 13/00* (2006.01)

(52) U.S. Cl.
CPC ..... *H01F 41/028* (2013.01); *H01F 1/40* (2013.01); *H01F 13/003* (2013.01); *H01F 41/0253* (2013.01)

(58) Field of Classification Search
CPC ..... H01F 13/003; H01F 1/40; H01F 41/0253; H01F 41/028
USPC ..... 29/607, 609, 596; 148/101, 103; 252/62.51 R, 62.55, 62.56
See application file for complete search history.

(56) References Cited

U.S. PATENT DOCUMENTS

| | | | | | |
|---|---|---|---|---|---|
| 2,903,329 | A | * | 9/1959 | Weber | 29/607 X |
| 2,933,427 | A | | 4/1960 | Marks et al. | |
| 3,126,347 | A | * | 3/1964 | Swoboda | 252/62.55 X |
| 5,047,743 | A | * | 9/1991 | Scesney | 29/607 X |
| 5,283,130 | A | | 2/1994 | Bradley et al. | |
| 5,523,731 | A | * | 6/1996 | Leupold | 29/607 X |
| 5,631,093 | A | | 5/1997 | Perry et al. | |
| 2004/0074083 | A1 | | 4/2004 | Laskaris et al. | |

FOREIGN PATENT DOCUMENTS

| | | | | | |
|---|---|---|---|---|---|
| GB | 697051 | | | 9/1953 | |
| JP | 61225814 | A | * | 10/1986 | 29/607 X |
| JP | 63-211708 | A | | 9/1988 | |
| JP | 01297807 | | | 11/1989 | |

(Continued)

*Primary Examiner* — A. Dexter Tugbang
(74) *Attorney, Agent, or Firm* — Harness, Dickey & Pierce, P.L.C.

(57) ABSTRACT

A method of magnetizing into a permanent magnet comprises placing magnetizing magnetic field applying means to be adjacent to an object to be magnetized into the permanent magnet, and continuing to apply a magnetizing magnetic field to the object by the magnetizing magnetic field applying means while cooling the object from a temperature of its Curie point or above to a temperature of below the Curie point.

7 Claims, 9 Drawing Sheets

(56) References Cited

FOREIGN PATENT DOCUMENTS

| | | | |
|---|---|---|---|
| JP | 3-72606 | A | 3/1991 |
| JP | 3-233910 | A | 10/1991 |
| JP | 2002-223548 | A | 8/2002 |
| JP | 2003257737 | | 9/2003 |
| JP | 2004-71853 | A | 3/2004 |

* cited by examiner

METHOD OF MAGNETIZING INTO PERMANENT MAGNET

CROSS-REFERENCE TO RELATED APPLICATIONS

The present application is a continuation-in-part of International Application PCT/JP2005/023513, with an international filing date of Dec. 21, 2005, which is herein incorporated by reference. The present application claims priority from Japanese Patent Applications No. 2004-374918 filed on Dec. 24, 2004, and No. 2005-343193 filed on Nov. 29, 2005, which are herein incorporated by reference.

BACKGROUND OF THE INVENTION

1. Technical Field of the Invention

The present invention relates to a method of magnetizing into a permanent magnet, and particularly to a method of magnetizing into a permanent magnet where while lowering the temperature of an object to be magnetized from a temperature of its Curie point or above to a temperature of below the Curie point, a magnetizing magnetic field continues to be applied to the object. This technique is effective in magnetizing a ring-like object into a multi-poled permanent magnet, which is used, for example, for a rotor of a stepping motor having a very small diameter but not limited thereto.

2. Related Art

In order to magnetize a ring-like rotor into a multi-poled permanent magnet that is incorporated in a radial-gap permanent magnet stepping motor or the like, a magnetizing device of a coil-energizing scheme is generally used. Such a magnetizing device has a structure where an object receiving hole in which a ring-like object to be magnetized into a permanent magnet can be removably inserted is made in, e.g., a magnetic yoke, where multiple grooves extending axially are formed in the inner side of the object receiving hole and where an insulation-coated conductor is laid through the grooves and the insulation-coated conductor in a winding shape forms a coil. A to-be-magnetized object is inserted into the object receiving hole, and by discharging the charge stored in a capacitor in an instant, a pulse current is made to flow through the coil, and the magnetic field created thereby magnetizes the object.

As well known, in recent years electronic apparatuses have become greatly smaller in size, and correspondingly, stepping motors and the like that are used therein have become increasingly small in size and diameter. When magnetizing into a multi-poled ring-like permanent magnet as a rotor, a large current in pulse form is made to flow with use of a magnetizing device of the above coil-energizing scheme, but as ring-like permanent magnets become smaller in diameter, the magnetization pitch (distance between magnetic poles) becomes narrower and thus the conductor of the above coil becomes thinner, thus limiting the allowable amount of current to flow through the conductor. Hence, the problem occurs that a sufficient magnetization characteristic is not obtained.

As a solution to this problem, a method has been proposed wherein a plurality of permanent magnets are arranged extending radially and thereby a plurality of opposite magnetic poles are arranged in the center and wherein a to-be-magnetized object is placed at the center, thereby magnetizing the object to be four or more multi-poled. Refer to Japanese Patent Application Laid-Open Publication No. 2001-268860. Certainly, by using such a magnetizing device of a permanent magnet scheme, the shortage of magnetization due to the magnetization pitches of magnetized objects being narrower can be alleviated to a certain degree.

However, recently the demand for stepping motors to be miniaturized and enhanced in performance is extremely high. For example, for the auto-focus mechanism of mobile image/video apparatuses, a small-pitch multi-pole magnetized stepping motor that can control a lens actuator highly accurately is an important electronic component to obtain highly fine images. Meanwhile, a magnetization characteristic of a saturated magnetization level is required of a ring-like permanent magnet as a rotor that has a small pitch structure with, e.g., 3 mm or less in diameter and the number of magnetized poles being ten or more. For such a structure, even with the above conventional magnetizing method of the permanent magnet scheme, the problem occurs that magnetization falls short and that variation between surface magnetic flux density peak values is large.

As a technique to alleviate the shortage of magnetization, a magnetizing method has been proposed which uses the fact that the magnetic field for saturated magnetization decreases in an atmosphere of high temperature or a liquid. Refer to Japanese Patent Application Laid-Open Publication No. H06-140248, which discloses that with, e.g., a Pr—Fe—B magnet that is a kind of rare-earth permanent magnet, because the magnetic field for magnetization is lower at 100° C. than at 25° C., by magnetizing at this higher temperature, saturated magnetization can be achieved with a stable low magnetic field.

However, when actually magnetized, with a ring-like permanent magnet having a narrow magnetization pitch such as the above very-small-diameter multi-poled magnet, although there is seen a slight improvement in the average of the peak values of surface magnetic flux density for all poles, variation between the peak values of surface magnetic flux density is still large. Hence, magnetization of high quality is extremely difficult.

SUMMARY OF THE INVENTION

An object of the present invention is to solve the problem that in the prior art, with annular or arc-like, very-small-diameter multi-poled permanent magnets having a narrow magnetization pitch, the average of the peak values of surface magnetic flux density for all magnetic poles is low (being short of magnetization) and variation between the peak values of surface magnetic flux density is large (being low in magnetization quality). Another object of the present invention is to enable a magnetized permanent magnet to have a very high magnetization characteristic corresponding to a true magnet characteristic, even if the magnet is made of a material large in coercivity.

In order to achieve the above objects and others, according to an aspect of the present invention, there is provided a method of magnetizing into a permanent magnet comprising placing magnetizing magnetic field applying means to be adjacent to an object to be magnetized into the permanent magnet; and continuing to apply a magnetizing magnetic field to the object by the magnetizing magnetic field applying means while cooling the object from a temperature of its Curie point or above to a temperature of below the Curie point. According to another aspect of the present invention, there is provided a method of magnetizing into a permanent magnet comprising placing magnetizing permanent magnets to be adjacent to an object to be magnetized into the permanent magnet; and continuing to apply a magnetizing magnetic field to the object by the magnetizing permanent magnets while cooling the object from a temperature of its Curie point or above and below a Curie point of the magnetizing permanent magnets to a temperature of below the Curie point of the object. This magnetizing magnetic field applying means may be of a coil-energizing scheme that applies a magnetic field created by energizing a coil or a permanent magnet scheme that applies a magnetic field by permanent magnets.

The object to be magnetized into the permanent magnet may be annular (circularly or polygonally) or arc-shaped (circularly or polygonally), and the magnetic field applying means may be placed outwards or inwards, or both inwards and outwards, of the object to apply the magnetizing magnetic field. In the case of the permanent magnet scheme, by use of, e.g., a magnetizing device having a structure where an object receiving hole in which the object to be magnetized can be removably inserted is made in a non-magnetic block, where a plurality of grooves extend radially from an outer edge of the object receiving hole and/or a plurality of grooves extend toward the center from an inner edge of the object receiving hole and where a magnetizing permanent magnet higher in Curie point than the object is inserted in each of the grooves, when having been heated to a temperature of its Curie point or above, the object may be inserted into the object receiving hole and cooled therein.

A plurality of the magnetizing devices having the plurality of magnetizing permanent magnets inserted therein may be placed axially one on top of another and oriented such that magnetic poles of the magnetizing devices are displaced circumferentially from each other, and the plurality of magnetizing devices may apply magnetizing magnetic fields laid one on top of another. Further, the magnetizing device or the magnetizing magnetic field applying means may be structured to have parts that apply magnetizing magnetic fields inward and outward of the object to be magnetized into the permanent magnet that is annular or arc-shaped, and the magnetizing magnetic field inward thereof and/or the magnetic field outward thereof may be adjusted in orientation and/or magnetic field intensity circumferentially to optimize a waveform of the magnetizing magnetic fields (the surface magnetic flux density against the center angle).

In these magnetizing methods, after heated to a temperature of its Curie point Tc+30° C. or above, the object in the magnetizing magnetic field/fields is preferably cooled to a temperature of the Curie point Tc−50° C. or below.

According to the present invention, the permanent magnet into which the object is magnetized is, for example, an Nd-based bonded magnet having coercivity (iHc) of greater than 557 kA/m.

Features and objects of the present invention other than the above will become clear by reading the description of the present specification with reference to the accompanying drawings.

EXPLANATION OF REFERENCE NUMERALS

10 Magnetizing device; 12 Non-magnetic block; 14 To-be-magnetized object; 16 Object receiving hole; 18 Groove; 20 Magnetizing permanent magnets; 22 Product

DETAILED DESCRIPTION OF THE INVENTION

At least the following matters will be made clear by the explanation in the present specification and the description of the accompanying drawings.

As mentioned above, for very-small-diameter multi-poled magnetized objects, the permanent magnet scheme is more effective than the coil-energizing scheme. More specifically, magnetizing permanent magnets are arranged to be adjacent to an object to be magnetized into a permanent magnet, and while lowering the temperature of the object from a temperature of its Curie point or above and below the Curie point of the magnetizing permanent magnets to a temperature of below the object's Curie point, a magnetizing magnetic field continues to be applied to the object by the magnetizing permanent magnets, thereby magnetizing the object. It will be described in more detail below that with this method, a ring-like object can be magnetized into a multi-poled permanent magnet.

Figure 1:
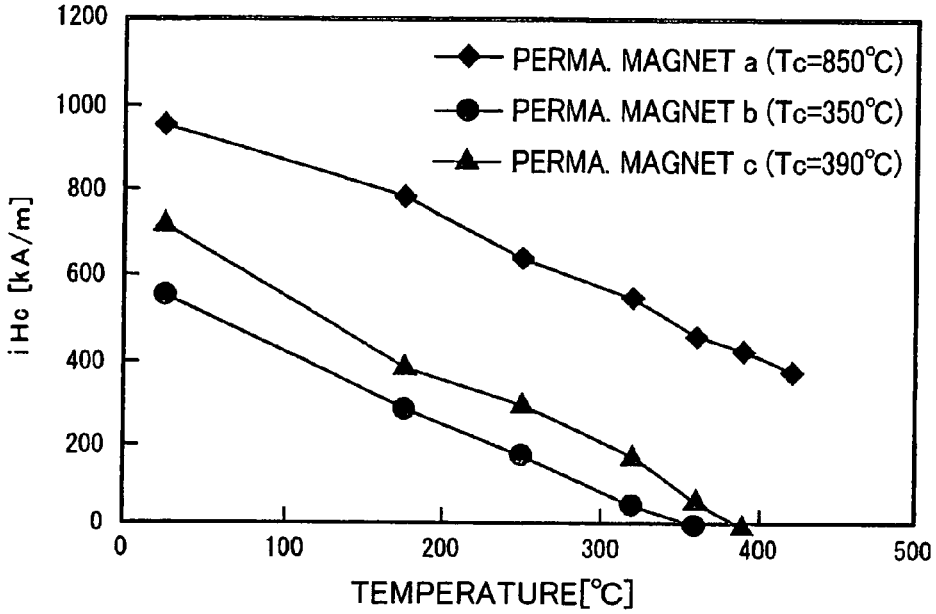
FIG. 1 shows the temperature characteristics of coercivity of permanent magnets different in Curie point.

For the following three types of permanent magnets a to c that are different in Curie point Tc, the temperature characteristic of coercivity iHc is shown in FIG. 1.

Permanent magnet a: A SmCo sintered magnet (Curie point being about 850° C.),

Permanent magnet b: A NdFeB isotropic magnet (Curie point being about 350° C.),

Permanent magnet c: A NdFeB isotropic magnet (Curie point being about 390° C.).

As seen from FIG. 1, at temperatures of above 390° C., while permanent magnets b and c lost their magnetization, permanent magnet a still maintained hard magnetization.

Figure 2:
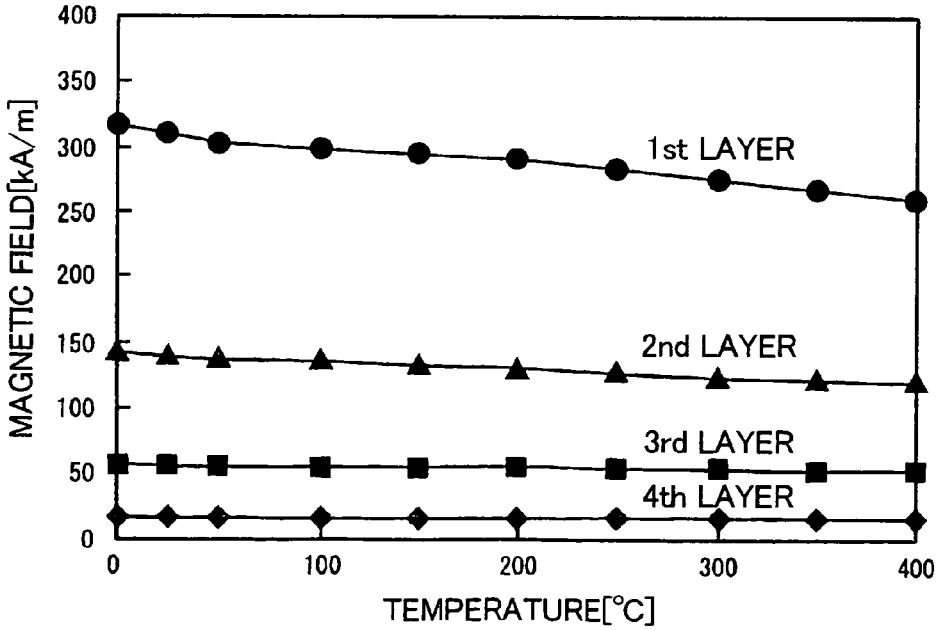
FIG. 2 shows the temperature characteristics of the magnetic field generated by magnetizing permanent magnets.

Permanent magnets a were arranged extending radially as magnetizing permanent magnets so as to form a ring-shaped space in the center in which a to-be-magnetized object can be placed. The ring-shaped space were divided into four layers equal in thickness (first to fourth layers in the order of from outside), and the temperature characteristic of the magnetic field occurring in each layer was calculated. FIG. 2 shows the results. It was found that when permanent magnets a are used as magnetizing permanent magnets, a magnetic field occurs over the wide range of the uppermost layer (first layer) to the lowermost layer (fourth layer) of the magnetizing space even at 400° C. that is above the Curie points of permanent magnets b and c, with magnetization capability over the permanent magnets b and c.

Figure 3A:
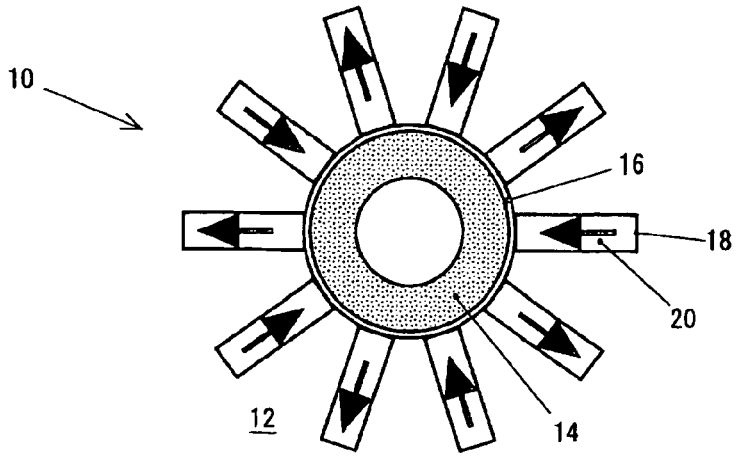
FIG. 3A is a plan view of an example of a magnetizing device according to the present invention.
Figure 3B:
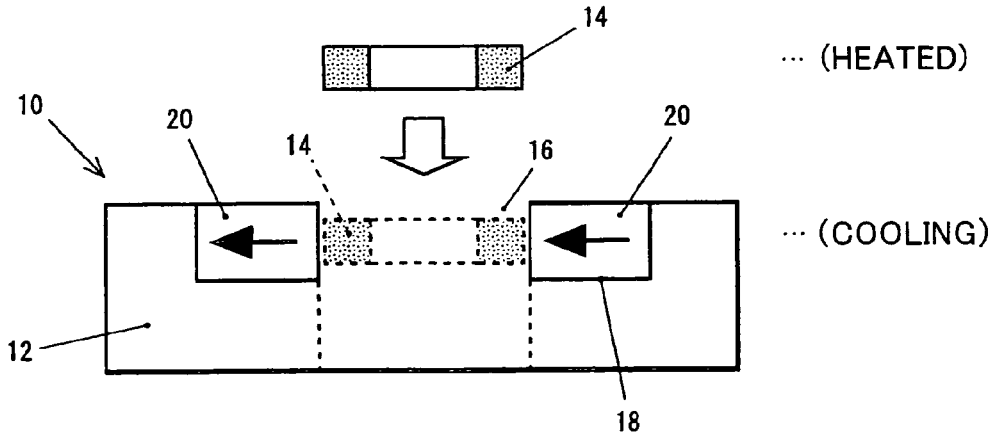
FIG. 3B is a cross-sectional view of the example of the magnetizing device.
Figure 4:
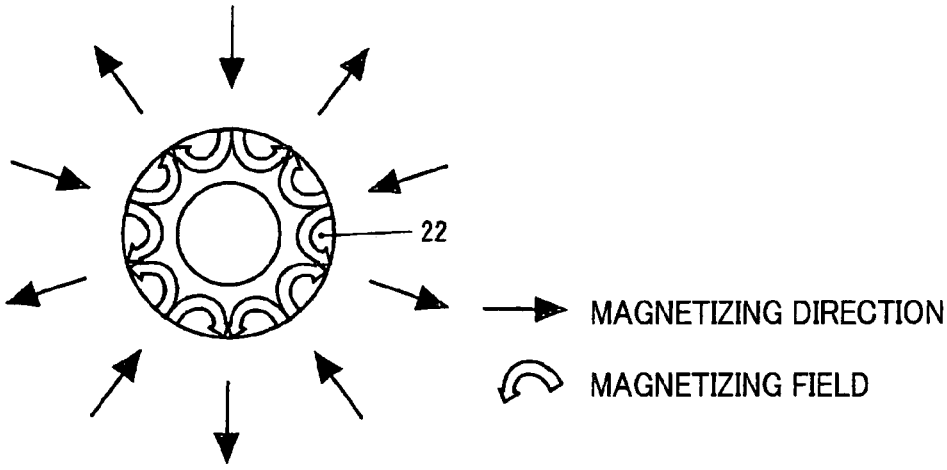
FIG. 4 shows the state of multi-poled magnetization of a ring-like permanent magnet magnetized by the device.

FIGS. 3A and 3B show an example of the magnetizing device. FIG. 3A is a plan view and FIG. 3B is a cross-sectional view. This is an example where a ring-like object is magnetized into a ten-poled permanent magnet. A magnetizing device 10 has a structure where a circular, object receiving hole 16 in which a to-be-magnetized object 14 can be removably inserted is made in a non-magnetic block (stainless steel block) 12, where ten grooves 18 having a rectangular cross-section are arranged an equal angular distance apart to extend radially from the outer edge of the object receiving hole 16 and where a bar-like magnetizing permanent magnet 20 having a rectangular cross-section that is higher in Curie point than the to-be-magnetized object 14 is inserted in each groove 18. When having been heated to a temperature of its Curie point or above, the to-be-magnetized object 14 is inserted into the object receiving hole 16, and a magnetizing magnetic field is applied thereto by the magnetizing permanent magnets 20. Then, the to-be-magnetized object 14 remaining in the magnetizing device 10 is cooled to a temperature of less than its Curie point and thereafter removed from the magnetizing device 10. By the way, when heating, any means such as resistance heating, high frequency heating, laser heating, high temperature gas flow heating, and heating in a high temperature liquid may be used, but the high frequency heating method is preferable which can heat in a short time. In cooling, any method such as natural cooling, water cooling, air cooling, forced cooling, e.g., by ejecting gas, and the adjustment of heating temperature may be used. When work in an inert atmosphere is necessary, an inert gas flow is used. It is preferable that the to-be-magnetized object 14 can be readily inserted into and removed from the object receiving hole 16 of the magnetizing device 10 by a movement mechanism (not shown). By this means, magnetic poles corresponding to the magnetizing magnetic poles emerge on the outer surface of the magnetized ring-like permanent magnet. FIG. 4 shows the state of the multi-poled magnetization of the ring-like permanent magnet, a product 22.

The Curie point of the magnetizing permanent magnets is set higher than that of the to-be-magnetized object so that the magnetizing permanent magnets can create a magnetic field to magnetize the to-be-magnetized object at high temperatures. And in order to minimize the magnitude of a magnetic field necessary to magnetize the to-be-magnetized object, the heating temperature is set higher than the Curie point of the to-be-magnetized object, and set less than the Curie point of the magnetizing permanent magnets so that the magnetizing permanent magnets retain a magnetic field to magnetize the to-be-magnetized object thus having a magnetizing capability. By this means, the to-be-magnetized object is magnetized to the maximum. Thereafter, when the magnetized object is cooled below its Curie point, the magnetized object produces a magnetic force. A sufficiently magnetized permanent magnet can be obtained at a room temperature.

Figure 5:
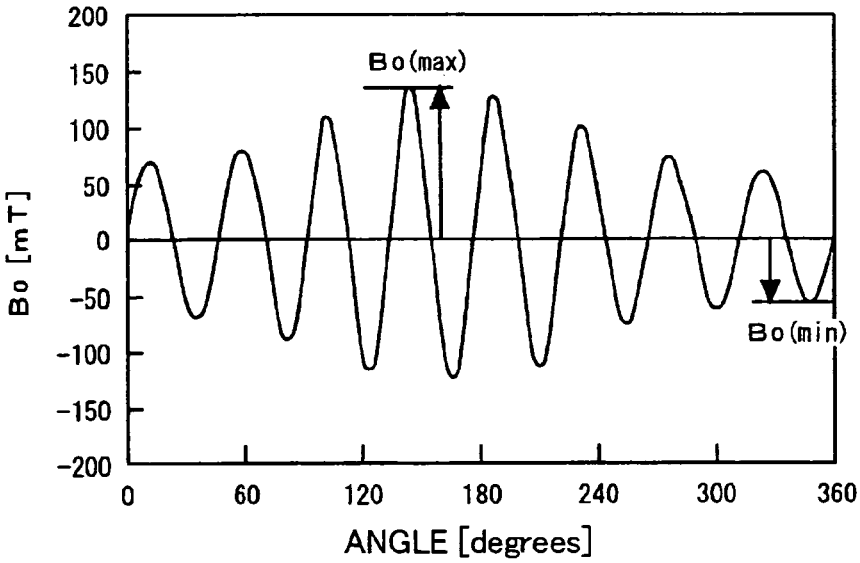
FIG. 5 shows the result of measuring the multi-poled magnetization.

The quality of magnetization using the method of the present invention can be evaluated quantitatively by measuring surface magnetic flux density with a Gauss meter. In the measurement, the variation in the surface magnetic flux density Bo [mT] over the outer surface of the magnetized ring-like permanent magnet against the center angle [degrees] relative to an arbitrary point, as shown in FIG. 5, is measured. Then, the following characteristics are obtained from the Bo peak values (absolute values) for all poles. FIG. 5 is a graph for 16 pole magnetization.

Bo(max) [mT]: The maximum of the Bo peak values for all poles,

Bo(min) [mT]: The minimum of the Bo peak values for all poles,

Bo(ave) [mT]: The average of the Bo peak values for all poles,

Bo variation [−] Variation between the Bo peak values={Bo(max)−Bo(min)}/Bo(ave).

Of these values, the Bo(ave) being great indicates the magnetization characteristic (magnetic force characteristic) being high, and the Bo variation being small indicates magnetization being of good quality.

According to the results of magnetizing under various conditions and measuring, it was found that after heated to Tc+30° C. or above, where Tc is its Curie point, the magnetized permanent magnet is preferably cooled to Tc−50° C. or below in the magnetizing magnetic field.

Figure 6:
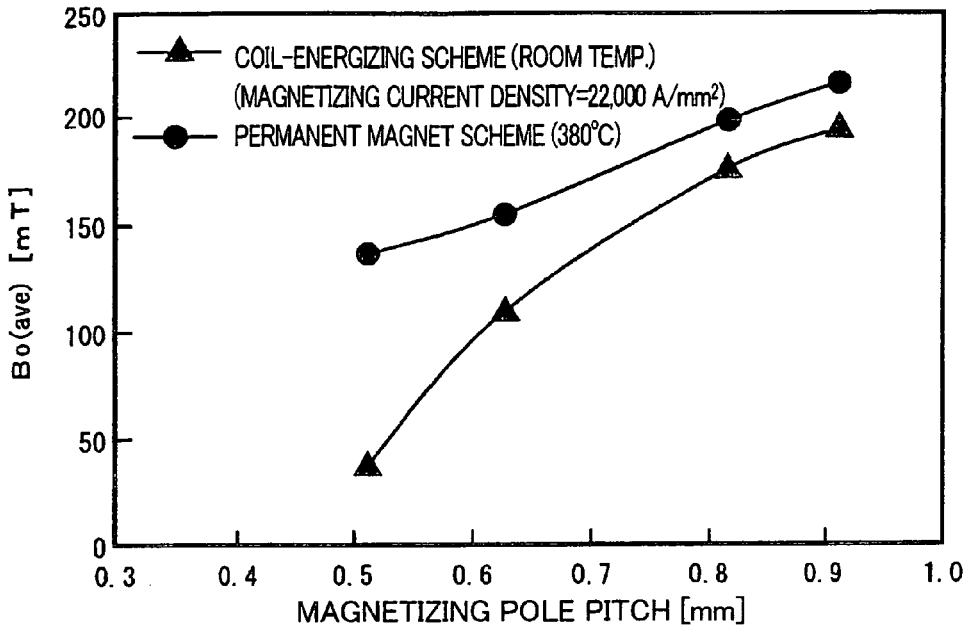
FIG. 6 shows a comparison between a coil-energizing scheme and a permanent magnet scheme.

Next, the comparison between a scheme of applying a magnetizing magnetic field by permanent magnets in a heated environment and a scheme of applying a magnetizing magnetic field created by energizing a coil at room temperature will be discussed. A graph labeled as a permanent magnet scheme in FIG. 6 shows Bo(ave) [mT], the average of the Bo peak values of the surface magnetic flux density, against the distance between magnetizing magnetic poles [mm], where the magnetized object is an NdFeB isotropic bonded magnet (its Curie point being about 350° C.) and the heating temperature is at 380° C. The permanent magnet scheme where SmCo sintered magnets (its Curie point being about 850° C.) are used as the magnetizing permanent magnets and the coil-energizing scheme (at room temperature) are shown for comparison. A magnetizing condition for the coil-energizing scheme was that magnetizing current density (22,000 $A/mm^2$) is practical such that the magnetizing coil endures at room temperature. Over the entire region where the distance between magnetizing magnetic poles is at 1 mm or less, the permanent magnet scheme is superior to the coil-energizing scheme. It was found that as the distance between magnetizing magnetic poles becomes smaller, its superiority is greater. That is, as the magnetized ring-like permanent magnets become more multiple poled with a very small diameter, the permanent magnet scheme becomes more advantageous. Further, because the permanent magnet scheme is simpler in configuration and although heated, the magnetizing device has an extended life time because mold resin is not necessary to fix a conductor. Yet further, because electric power is not necessary in magnetizing, the cost can be lowered.

The results for the permanent magnet scheme coinciding with values (potentials) calculated in a magnetic field analysis indicates the magnetization rate being theoretically at 100%. Therefore, it is seen that there is no magnetizing scheme better than this scheme.

While the above description concerns an example where a ring-like object is magnetized into a permanent magnet by magnets placed outwards thereof, the present invention is applicable to magnetization by magnets placed inwards thereof or magnets placed inwards and outwards thereof.

With these methods, magnetic poles corresponding to the magnetizing magnetic poles emerge on the inner surface, or the inner and outer surfaces, of a magnetized ring-like permanent magnet.

Figure 7A:
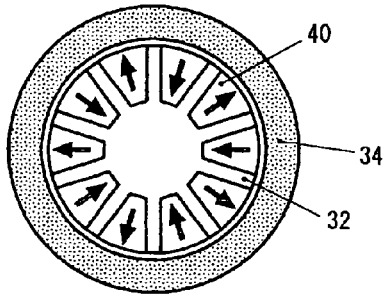
FIG. 7A is a plan view of an example of an inside magnetizing device.
Figure 7B:
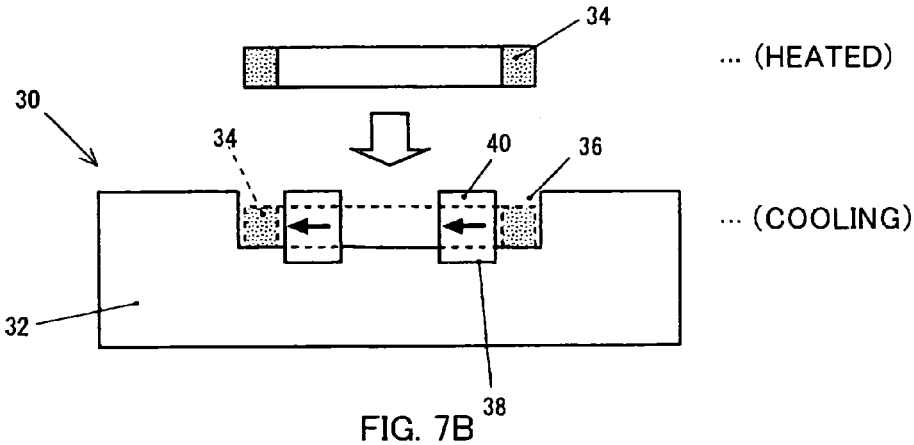
FIG. 7B is a cross-sectional view of the example of the inside magnetizing device.

An example of an inside magnetizing device is shown in FIGS. 7A, 7B, and is the same in basic configuration as in FIGS. 3A, 3B, with a brief description being warranted. FIG. 7A is a plan view and FIG. 7B is a cross-sectional view. This is also an example where a ring-like object is magnetized into a ten-poled permanent magnet. A magnetizing device 30 has a structure where an annular, object receiving hole 36 in which a to-be-magnetized object 34 can be removably inserted is made in a non-magnetic block 32, where ten grooves 38 are arranged an equal angular distance apart to extend toward the center from the inner edge of the object receiving hole 36 and where a magnetizing permanent magnet 40 that is higher in Curie point than the to-be-magnetized object 34 is inserted in each groove 38. When the to-be-magnetized object 34 has been heated to a temperature of its Curie point or above, it is inserted into the object receiving hole 36, and a magnetizing magnetic field is applied thereto by the magnetizing permanent magnets 40. Then, the to-be-magnetized object 34 remaining in the magnetizing device 30 is cooled to a temperature of less than its Curie point and thereafter removed from the magnetizing device 30. Thereby, the inner surface is magnetized.

Figure 8:
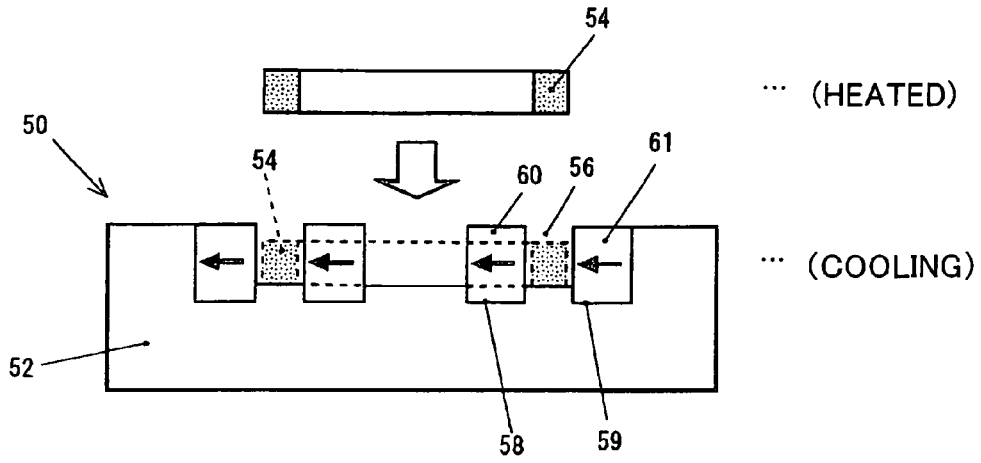
FIG. 8 is a cross-sectional view of an example of an inside-outside magnetizing device.

A cross-sectional view of an example of an inside-outside magnetizing device is shown in FIG. 8. A magnetizing device 50 has a structure where an annular, object receiving hole 56 in which a to-be-magnetized object 54 can be removably inserted is made in a non-magnetic block 52, where multiple grooves 58 are arranged an equal angular distance apart to extend toward the center from the inner edge of the object receiving hole 56 and the same number of grooves 59 are arranged an equal angular distance apart to extend radially from the outer edge thereof and where magnetizing permanent magnets 60, 61 that are higher in Curie point than the to-be-magnetized object 54 are inserted in each groove 58 and each groove 59. When having been heated to a temperature of its Curie point or above, the to-be-magnetized object 54 is inserted into the object receiving hole 56, and a magnetizing magnetic field is applied thereto by the magnetizing permanent magnets 60, 61. Then, the to-be-magnetized object 54 remaining in the magnetizing device 50 is cooled to a temperature of less than its Curie point and removed from the magnetizing device 50. Thereby, both the inner and outer surfaces are magnetized.

Figure 9A:
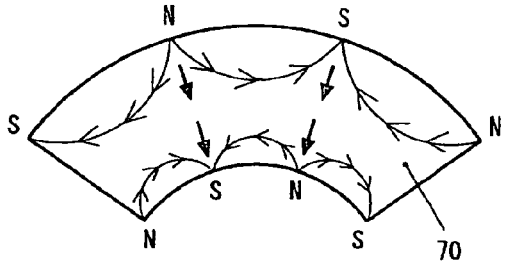
FIG. 9A shows a state of magnetization by the inside-outside magnetizing device.
Figure 9B:
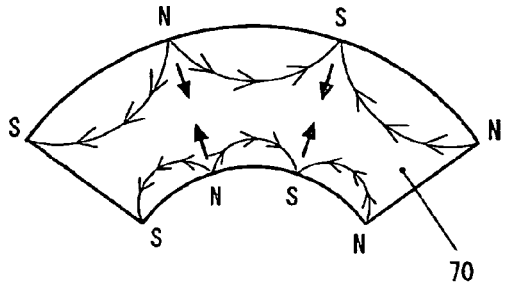
FIG. 9B shows a state of magnetization by the inside-outside magnetizing device.

In the case of both the inner and outer surfaces to be magnetized, magnetizing magnetic field applying means can be placed oriented in any direction around an annular or arc-shaped object to be magnetized into a permanent magnet. If the magnetizing magnetic field applying means is arranged such that magnetic poles of opposite polarities on the inward and outward sides of a to-be-magnetized object 70 are opposite each other as shown in FIG. 9A, the magnetizing magnetic field is intensified as shown by thick arrows. On the other hand, if the magnetizing magnetic field applying means is arranged such that magnetic poles of the same polarity on the inward and outward sides of the to-be-magnetized object 70 are opposite each other as shown in FIG. 9B, the magnetizing magnetic field is weakened as shown by thick arrows. By displacing the magnetic poles on the inward side from those on the outward side relatively circumferentially, the magnetization of the inner and outer surfaces of the magnetized object can be adjusted. Because the outer magnetizing magnetic field can be partially intensified or weakened by the inner magnetizing magnetic field, a desired optimum magnetization pattern (distribution pattern of the surface magnetic flux density on the magnetized object against the center angle) can be realized.

Figure 10A:
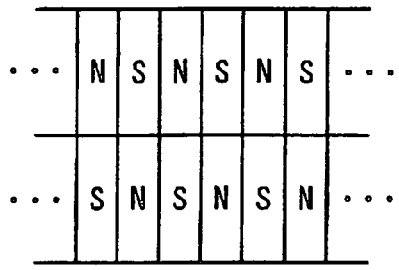
FIG. 10A shows an example of a magnetization pattern.
Figure 10B:
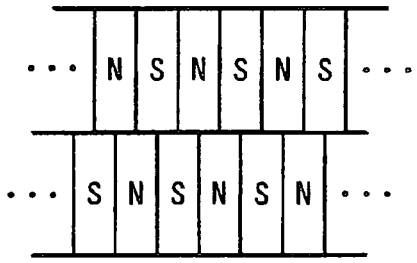
FIG. 10B shows an example of the magnetization pattern.
Figure 10C:
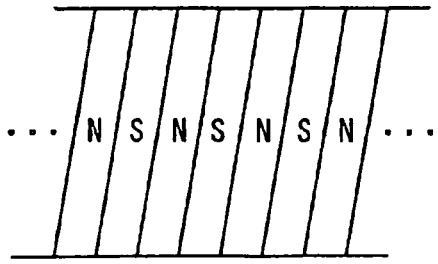
FIG. 10C shows an example of the magnetization pattern.

According to the method of the present invention, only one magnetizing magnetic field applying means may be provided, and two of the magnetizing magnetic field applying means may be placed one on top of the other. Examples of the magnet magnetized using the latter configuration are shown in FIGS. 10A, 10B. FIGS. 10A to 10C show magnetization patterns where the magnetized surfaces of a magnetized object are made to extend straight. In FIG. 10A, the magnet is magnetized such that magnetic poles of opposite polarities (the phases being 180 degrees displaced) emerge one on top of the other axially. In FIG. 10B, the magnet is magnetized such that upper and lower magnetic poles in the axial direction are displaced horizontally from each other (the phases being 90 degrees displaced). When two of the magnetizing magnetic field applying means are placed one on top of the other, upper and lower magnetic poles in the axial direction can be displaced from each other by any amount. For the permanent magnet scheme, it is easy to place the magnetizing magnetic field applying means one on top of the other so as to be displaced circumferentially. For various motors including, but not limited to, a stepping motor, cogging torque is variation in torque and causes noise or variation in rotation. Hence, it is desirable that no cogging torque exists. The cogging can be cancelled out by creating cogging that is 180 degrees displaced in phase, thereby eliminating cogging torque. Magnetization patterns having such a characteristic can be easily obtained. Skewed magnetization as shown in FIG. 10C can be realized, e.g., by placing the magnetizing permanent magnets to lean.

EXAMPLES

Ring-like NdFeB isotropic bonded magnets of 2.6 mm in outer diameter and 1.0 mm in inner diameter (its Curie point being about 350° C.) were used as to-be-magnetized objects and heated to two temperatures of the Curie point ±30° C. (380° C. for the invented method, 320° C. for a comparative example) and magnetized to be 16-poled with use of the same magnetizing device. Table 1 shows the results (surface magnetic flux density Bo).

TABLE 1

| | Invented Method (Heating Temp. = 380° C.) | Comparative Example (Heating Temp. = 320° C.) |
|---|---|---|
| Bo(max) [mT] | 153 | 135 |
| Bo(min) [mT] | 127 | 54 |
| Bo(ave) [mT] | 138 | 91 |
| Bo variation [-] | 0.19 | 0.89 |

For the comparative example where the object was heated to 320° C. which is less than the Curie point, the peak values of the surface magnetic flux density Bo are small and the Bo variation is large. This is perceived to be because there were insufficiently magnetized regions in the magnetized object. In contrast, for the invented method where the object was heated to 380° C. which is at or above the Curie point, the peak values of the surface magnetic flux density Bo are great and the Bo variation is small. And it is seen that its magnetic force characteristic and magnetization quality are both good.

Figure 11:
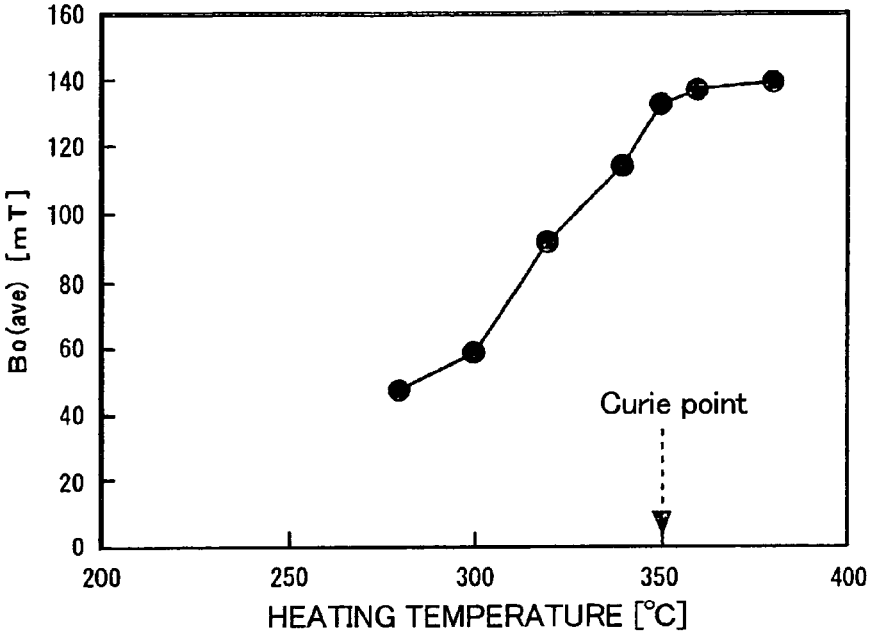
FIG. 11 is a graph of the dependency on the heating temperature of the average of the surface magnetic flux density peak values for all poles.
Figure 12:
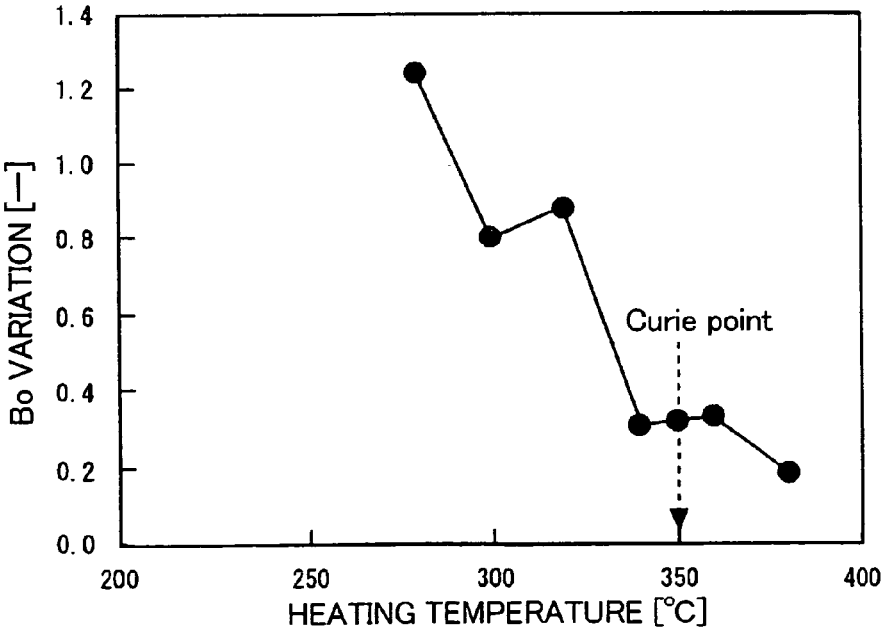
FIG. 12 is a graph of the dependency on the heating temperature of variation between the surface magnetic flux density peak values.

With use of the same to-be-magnetized objects and the same magnetizing device as above, the magnetic force characteristic was measured while changing the heating temperature over a wide range, which results are shown in FIGS. 11, 12. FIG. 11 shows the dependency on the heating temperature of the average Bo(ave) of the surface magnetic flux density peak values for all poles, and FIG. 12 shows the dependency on the heating temperature of variation between the surface magnetic flux density peak values. It is seen from FIG. 11 that for the heating temperatures at or above the Curie point of the to-be-magnetized objects, the Bo(ave) is high, that is, a high magnetic force characteristic is obtained. It is seen from FIG. 12 that for the heating temperatures at or above the Curie point of the objects, the Bo variation is small, that is, the magnets are of good quality with stable characteristics. It is seen that particularly when heated to about Tc+30° C., the magnetic force characteristic and quality are the highest.

Figure 13:
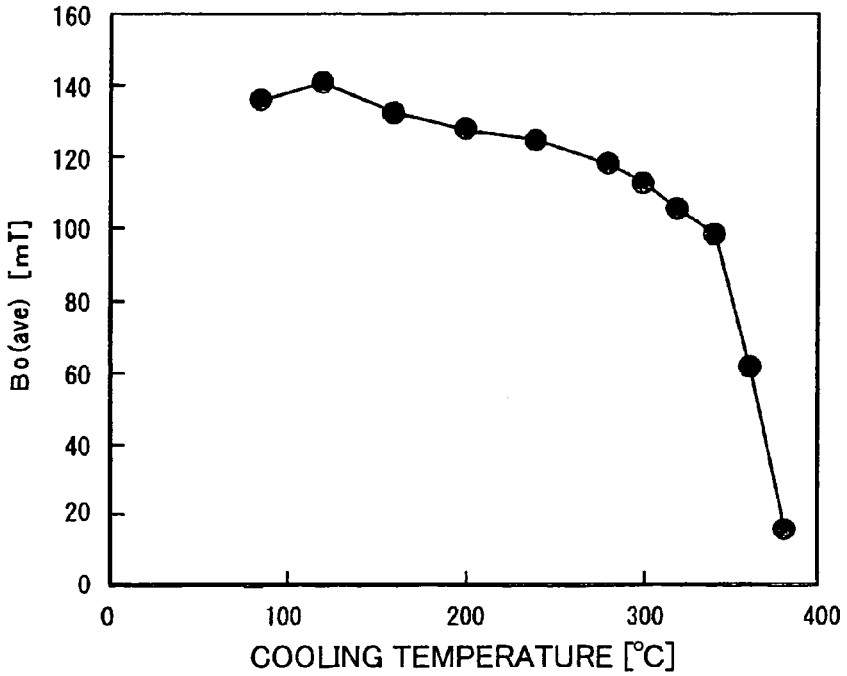
FIG. 13 is a graph of the dependency on the cooling temperature of the average of the surface magnetic flux density peak values for all poles.
Figure 14:
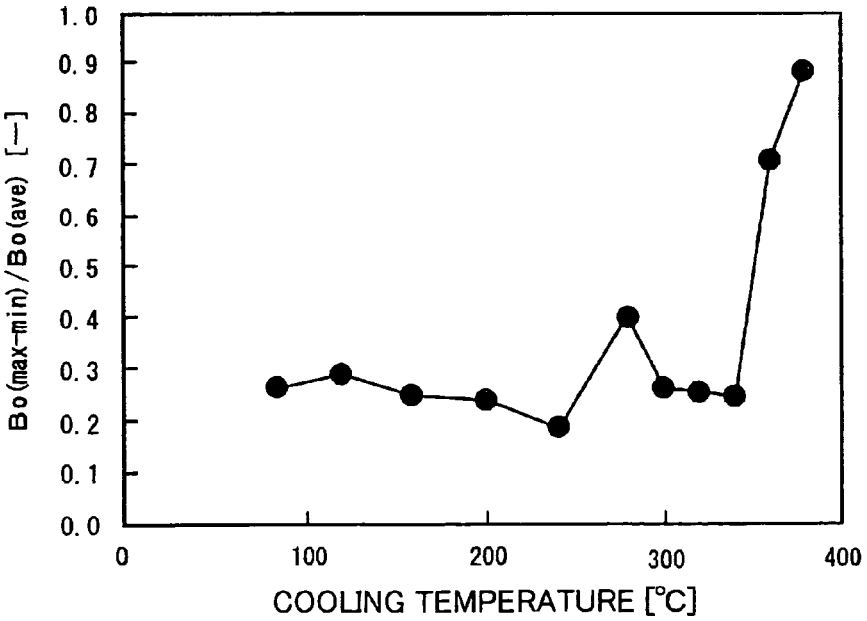
FIG. 14 is a graph of the dependency on the cooling temperature of variation between the surface magnetic flux density peak values.

With use of the same to-be-magnetized objects and the same magnetizing device as above, after heated to 380° C. which is 30° C. higher than the Curie point, the objects in the magnetizing space were cooled to various temperatures and removed. Then, their magnetic force characteristics were measured, which results are shown in FIGS. 13, 14. FIG. 13 shows the dependency on the cooling temperature of the average Bo(ave) of the surface magnetic flux density peak values for all poles, and FIG. 14 shows the dependency on the cooling temperature of variation between the surface magnetic flux density peak values. It is seen from FIG. 13 that unless the objects in the magnetizing space are cooled to a certain level, the magnetic force characteristic does not emerge. To be specific, if the objects in the magnetizing space are cooled below the objects' Curie point, the magnetic force characteristic becomes high and its variation becomes very small. The lower the temperature at which to remove is, the higher the magnetic force characteristic and quality is. It is seen that particularly if cooled to about Tc−50° C., variation in the magnetic force characteristic becomes the minimum level.

According to the present invention, although the object to be magnetized may be made of any material, the invented method is especially effective to material that is difficult to magnetize with the conventional magnetizing method which uses a general magnetic field (that is at about 1592 kA/m: there is a general limit to a magnetic field generated by a current when magnetizing or measuring the magnet characteristic, the limit being called a general magnetic field). One of such materials is an Nd-based bonded magnet having coercivity (iHc) of greater than 557 kA/m.

Figure 15:
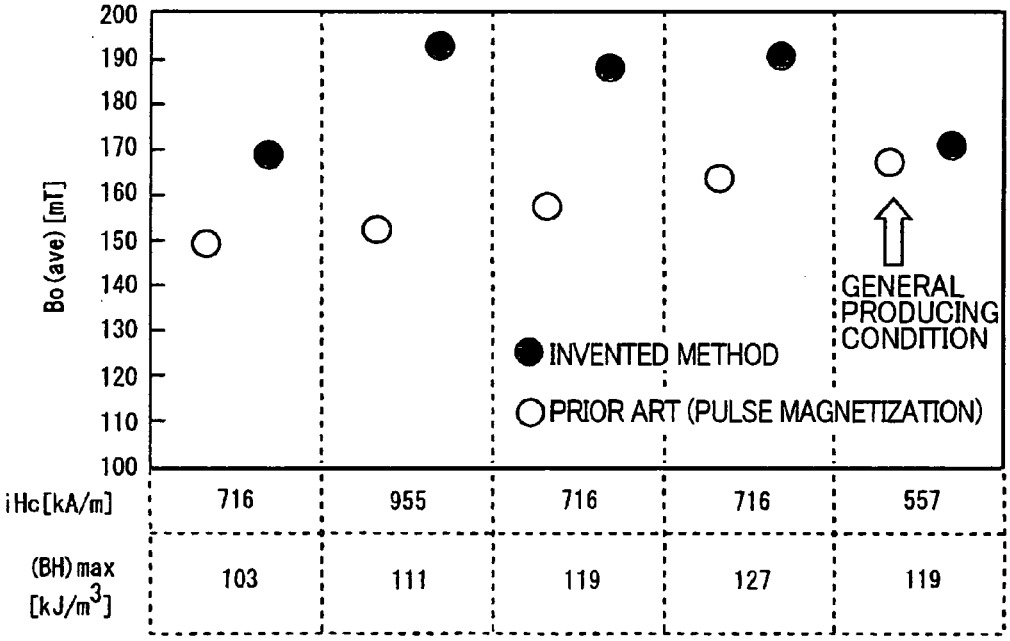
FIG. 15 shows a comparison between the magnetization characteristics of magnets having high coercivity.

Ring-like Nd-based bonded magnets of 2.6 mm in outer diameter, 1.0 mm in inner diameter, and 3.0 mm in length were used as to-be-magnetized objects and magnetized to be ten-poled, and their magnetization characteristic was measured. The heating condition was set as needed for each magnetic powder. Soon after heated, the to-be-magnetized objects were mounted in the magnetizing device at 80° C. and magnetized. Five types of Nd-based bonded magnets of different magnetic characteristics were compared in terms of the magnetization characteristic, which results are shown in FIG. 15. Magnets having coercivity (iHc) of 557 kA/m and (BH) max of 119 kJ/m3 are generally considered to be good in magnetization characteristic in the conventional art. It is seen from FIG. 15 that especially for magnets difficult to sufficiently magnetize with the general magnetic field (about 1592 kA/m) such as Nd-based bonded magnets having coercivity (iHc) of greater than 557 kA/m, the invented method is effective.

The invented method is a method of magnetizing into a permanent magnet wherein while cooling the to-be-magnetized object from a temperature of its Curie point or above to a temperature of below the Curie point, a magnetizing magnetic field continues to be applied. According to this method, an annular or arc-shaped permanent magnet can be obtained easily and at a low cost wherein even though the permanent magnet has a small-diameter multi-pole magnetized structure, the average of the surface magnetic flux density peak values for all poles is high and variation between the surface magnetic flux density peak values is small, that is, the magnetization characteristic (magnetic force characteristic) is high and the magnetization quality is good.

The scheme that uses permanent magnets having a high Curie point as the magnetizing magnetic field applying means can easily deal with narrower pitches, hence being effective in magnetizing into a ten or more multi-poled ring-like permanent magnet having a very small diameter of 3 mm or less, and has an advantage that the cost can be lowered because the magnetizing device is simpler and has a longer life time without the need to be energized.

If it is desired that a to-be-magnetized object be magnetized into a permanent magnet by magnets inward thereof, with the conventional art, a large enough magnetizing magnetic field may not be obtained because there is not enough space for magnetizing magnetic field applying means to be placed in, but according to the present invention, since a sufficient magnetization characteristic is obtained with a small magnitude magnetizing magnetic field, good magnetization can be performed by magnets inward of the object.

By applying the invented method to-be-magnetized objects difficult to sufficiently magnetize with the conventional general magnetic field (a general generated magnetic field by energizing of about 1592 kA/m), sufficient magnetization can be performed efficiently. According to the present invention, magnet materials of high coercivity (i.e. difficult to magnetize) and high heat-resistance such as an Nd-based bonded magnet having coercivity (iHc) of greater than 557 kA/m can be magnetized effectively. Thus, the invented method is applicable to new electromagnetic devices (for example, vehicle-mounted motors that need to be heat-resistant).

Although the preferred embodiment of the present invention has been described in detail, it should be understood that various changes, substitutions and alterations can be made therein without departing from spirit and scope of the inventions as defined by the appended claims.

What is claimed is:

1. A method of magnetizing into a permanent magnet comprising:

heating an object to be magnetized into a permanent magnet to a predetermined heating maximum temperature that is higher than a Curie point of the object and lower than a Curie point of magnetizing permanent magnets; and placing the magnetizing permanent magnets adjacent to the object to be magnetized into the permanent magnet once the object has reached the predetermined heating maximum temperature from said heating, and continuing to apply a magnetizing magnetic field to the object by the magnetizing permanent magnets while cooling the object from the predetermined heating maximum temperature that is higher than the Curie point of the object and lower than the Curie point of magnetizing permanent magnets to a temperature that is lower than the Curie point of the object, the predetermined heating maximum temperature being a highest temperature during a process of being heated and then cooled.

2. The magnetizing method according to claim 1, wherein the object to be magnetized into the permanent magnet is annular or arc-shaped, and the magnetic field applying means is placed outwards or inwards, or both outwards and inwards, of the object to apply the magnetizing magnetic field.

3. The magnetizing method according to claim 2, wherein, by use of a magnetizing device having a structure in which an object receiving hole in which the object to be magnetized can be removably inserted is made in a non-magnetic block, a plurality of grooves extend radially from an outer edge of the object receiving hole and/or a plurality of grooves extend toward the center from an inner edge of the object receiving hole, and a magnetizing permanent magnet higher in Curie point than the object is inserted in each of the grooves, the object is inserted into the object receiving hole and cooled therein with the object being heated to a temperature that is higher than or equal to its Curie point.

4. The magnetizing method according to claim 3, wherein a plurality of the magnetizing devices having the plurality of magnetizing permanent magnets inserted therein are placed axially one on top of another and oriented such that magnetic poles of the magnetizing devices are displaced circumferentially from each other, and the plurality of magnetizing devices apply magnetizing magnetic fields laid one on top of another.

5. The magnetizing method according to claim 2, wherein a plurality of the magnetizing devices having the plurality of magnetizing permanent magnets inserted therein are placed axially one on top of another and oriented such that magnetic poles of the magnetizing devices are displaced circumferentially from each other, and the plurality of magnetizing devices apply magnetizing magnetic fields laid one on top of another.

6. The magnetizing method according to claim 1, wherein, by use of a magnetizing device having a structure in which an object receiving hole in which the object to be magnetized can be removably inserted is made in a non-magnetic block, plurality of grooves extend radially from an outer edge of the object receiving hole and/or a plurality of grooves extend toward the center from an inner edge of the object receiving hole, and a magnetizing permanent magnet higher in Curie point than the object is inserted in each of the grooves, the object is inserted into the object receiving hole and cooled therein with the object being heated to a temperature that is higher than or equal to its Curie point.

7. The magnetizing method according to claim 6, wherein a plurality of the magnetizing devices having the plurality of magnetizing permanent magnets inserted therein are placed axially one on top of another and oriented such that magnetic poles of the magnetizing devices are displaced circumferentially from each other, and the plurality of magnetizing devices apply magnetizing magnetic fields laid one on top of another.

* * * * *